US009260815B2

(12) United States Patent
Frushtick

(10) Patent No.: US 9,260,815 B2
(45) **Date of Patent: *Feb. 16, 2016**

(54) GARMENT TUNNEL FINISHER WITH ATOMIZED SPRAY AND HOT AIR MIX

(71) Applicant: LEONARD AUTOMATICS, INC., Denver, NC (US)

(72) Inventor: Jeffrey Neal Frushtick, Denver, NC (US)

(73) Assignee: Leonard Automatics, Inc., Denver, NC (US)

( * ) Notice: Subject to any disclaimer, the term of this patent is extended or adjusted under 35 U.S.C. 154(b) by 1 day.

This patent is subject to a terminal disclaimer.

(21) Appl. No.: 14/330,342

(22) Filed: Jul. 14, 2014

(65) Prior Publication Data

US 2014/0352367 A1 Dec. 4, 2014

Related U.S. Application Data

(63) Continuation of application No. 12/903,432, filed on Oct. 13, 2010, now Pat. No. 8,806,903, which is a continuation-in-part of application No. 11/612,752, filed on Dec. 19, 2006, now Pat. No. 7,845,197, which is a continuation-in-part of application No. 11/421,247, filed on May 31, 2006, now Pat. No. 7,845,037.

(60) Provisional application No. 60/685,900, filed on May 31, 2005.

(51) Int. Cl.
*D06F 73/02* (2006.01)

(52) U.S. Cl.
CPC ..... *D06F 73/02* (2013.01)

(58) Field of Classification Search
CPC ..... D06F 73/02
See application file for complete search history.

(56) References Cited

U.S. PATENT DOCUMENTS

| | | | | | |
|---|---|---|---|---|---|
| 2,859,902 | A * | 11/1958 | Jordan | A47G 25/62 | 223/63 |
| 3,696,523 | A * | 10/1972 | Beeley | D06F 73/02 | 211/1.52 |
| 3,732,628 | A * | 5/1973 | Blevens | D06F 73/02 | 239/425 |
| 4,761,305 | A * | 8/1988 | Ochiai | D06F 73/02 | 427/180 |
| 4,823,488 | A * | 4/1989 | Fottner | D06F 73/02 | 38/14 |
| 6,311,526 | B1 * | 11/2001 | Frushtick | D06F 73/02 | 223/51 |
| 2008/0034807 | A1 * | 2/2008 | Littmann | D06F 73/02 | 68/5 C |

* cited by examiner

*Primary Examiner* — Michael Barr
*Assistant Examiner* — Benjamin L Osterhout
(74) *Attorney, Agent, or Firm* — Shumaker, Loop & Kendrick, LLP

(57) ABSTRACT

A laundry tunnel finisher including a tunnel providing a moisturizing zone therein having a non-linear conveyor pathway therethrough with curved portions adjacent the entrance and exit of the tunnel, at least one nozzle directed at the curved portions of the pathway, a hot water source supplying hot water to the at least one nozzle, a compressed air source supplying compressed air to the at least one nozzle, and a hot air source directing hot air into the tunnel, wherein hot water is atomized using compressed air and is sprayed through the at least one nozzle and mixed with hot air in the tunnel to raise the temperature in the moisturizing zone.

15 Claims, 6 Drawing Sheets

GARMENT TUNNEL FINISHER WITH ATOMIZED SPRAY AND HOT AIR MIX

CROSS-REFERENCE TO RELATED APPLICATIONS

This application is a continuation application claiming priority to U.S. application Ser. No. 12/903,432 filed Oct. 13, 2010, which is a continuation-in-part application claiming priority to U.S. application Ser. No. 11/612,752 filed Dec. 19, 2006, which is a continuation-in-part application claiming priority to U.S. application Ser. No. 11/421,247 filed May 31, 2006, which claims priority to U.S. Provisional Application No. 60/685,900 filed May 31, 2005, the contents of each of which are incorporated by reference herein.

TECHNICAL FIELD AND BACKGROUND OF THE INVENTION

1. Field of the Invention

The present invention relates generally to the field of garment tunnel finishers for use in the laundering industry, and more particularly, to a garment tunnel finisher that utilizes atomized hot water mixed with hot air in a moisturizing zone of the finisher to treat fabric as opposed to steam used in conventional tunnel finishers.

2. Background of the Invention

Known to those skilled in the art, tunnel finishers are used in the laundering industry to remove wrinkles set into garments, and generally include a predefined conveyor pathway along which garments travel through a series of interconnected tunnels where moisture is applied to and then evaporated from the garments in order to remove wrinkles. Conventional tunnel finishers typically first include a moisturizing, or "steaming", zone along their conveyor pathway in which steam is directed to the garments to moisturize the fibers and release the wrinkles, followed by a hot air zone in which the moisture is evaporated from the garments and the garments are dried. In conventional tunnel finishers, the moisturizing medium is typically steam and is applied to the garments in the moisturizing zone.

The use of steam as the moisturizing medium in conventional tunnel finishers disadvantageously requires an on-site boiler system for steam production, associated piping to deliver steam from the boiler to the injection site, condensate return lines, maintenance of steam traps and check valves, and often times requires a stationary engineer to be present on-site to monitor the operation of the boiler system, collectively leading to high installation, operating and maintenance costs. Further, using steam to bring the temperature of the garments in the moisturizing zone to a desired temperature (e.g. about 160 degrees F.) requires great energy and cost.

Therefore, what is desired is an alternative moisturizing medium that overcomes the disadvantages of using steam while advantageously bringing the garment fabrics up to temperature quickly while conserving energy and costs.

BRIEF SUMMARY OF THE INVENTION

Accordingly, it is an object of the invention to eliminate the use of steam in a tunnel finisher while duplicating a steam like atmosphere for conditioning garments.

It is another object of the invention to provide a simplified tunnel finisher system that does not require an on-site boiler, associated piping and high costs of operation and maintenance.

It is another object of the invention to provide a tunnel finisher that utilizes hot water atomized into the moisturizing zone and mixed with hot air to condition garments. Hot water may be plant supplied or supplied from a hot water generator associated with the machine.

It is another object of the invention to minimizes the amount of cool air that is drafted into the tunnel finisher to help maintain the high temperature in the moisturizing zone.

It is another object of the invention to provide a tunnel finisher having a non-linear conveyor path through the moisturizing zone.

It is another object of the invention to provide a tunnel finisher having 90-degree turns within the moisturizing zone to allow moisture to effectively penetrate the garments.

These and other objects of the invention are achieved by providing a tunnel finisher including a tunnel defining a moisturizing zone and having a non-linear garment conveyor pathway therethrough having a first curve within the tunnel adjacent an entrance of the tunnel and a second curve within the tunnel adjacent an exit of the moisturizing zone of the tunnel, a bank of nozzles positioned within the tunnel adjacent an outer portion of at least one of the first and second curves, a hot water source supplying hot water to the nozzle, a compressed air source supplying compressed air to the nozzle, and a hot air source directing hot air into the tunnel, wherein hot water from the hot water source is atomized with compressed air from the compressed air source and sprayed into the tunnel through the nozzles and is mixed with hot air from the hot air source to raise the temperature in the moisturizing zone.

According to another embodiment, each of the first and second curves are 90-degree curves.

According to another embodiment, the nozzles are directed at non-perpendicular angles relative to the conveyor pathway, the finisher further includes a plurality of nozzles positioned adjacent the first and second curves, and the finisher further includes a plurality of nozzles positioned along a length of the tunnel and directed to the conveyor pathway.

According to another embodiment, the finisher further includes a second tunnel defining a hot air zone arranged in a continuous and side-by-side manner with the tunnel and enclosing a portion of the conveyor pathway, the conveyor pathway including a U-turn from the exit of the tunnel into an entrance of the second tunnel.

According to another embodiment, the finisher further includes at least one hot air chamber disposed in the second tunnel.

According to another embodiment, the finisher further includes an exhaust hood for exhausting moisture-laden air.

In a further embodiment, hot water from the hot water source has a temperature from about 150 degrees F. to about 190 degrees F., and hot air from the hot air source has a temperature from about 220 degrees F. to about 300 degrees F.

According to another embodiment of the invention, a laundry tunnel finisher is provided including a generally linear tunnel having an entrance and an exit positioned adjacent opposed ends thereof and defining a moisturizing zone within its interior, a non-linear garment conveyor extending between the entrance and the exit of the tunnel and defining curved portions adjacent each of the entrance and the exit, a plurality of nozzles disposed within the tunnel and directed at the curved portions of the conveyor, a hot water source supplying hot water to the nozzles, a compressed air source supplying compressed air to the nozzles, and a hot air source directing hot air into the tunnel, wherein hot water from the hot water source is atomized with compressed air from the compressed air source and sprayed into the tunnel through the nozzles and is mixed with hot air from the hot air source to raise the temperature in the moisturizing zone.

According to another embodiment of the invention, a laundry tunnel finisher is provided including a tunnel providing a moisturizing zone therein having a non-linear conveyor pathway therethrough having curved portions adjacent an entrance and an exit of the moisture zone of the tunnel, at least one nozzle directed at the curved portions of the pathway, a hot water source supplying hot water to at least one nozzle, a compressed air source supplying compressed air to at least one nozzle, and a hot air source directing hot air into the tunnel, wherein the hot water is atomized using the compressed air and is sprayed through at least one nozzle and mixed with the hot air in the tunnel to raise the temperature in the moisturizing zone.

Additional features, aspects and advantages of the invention are set forth in the detailed description which follows, and in part will be readily apparent to those skilled in the art from that description or recognized by practicing the invention as described herein.

BRIEF DESCRIPTION OF THE DRAWINGS

The present invention is understood when the following detailed description of the invention is read with reference to the accompanying drawings, in which.

DETAILED DESCRIPTION OF THE INVENTION

The present invention will now be described more fully hereinafter with reference to the accompanying drawings in which exemplary embodiments of the invention are shown. However, the invention may be embodied in many different forms and should not be construed as limited to the representative embodiments set forth herein. The exemplary embodiments are provided so that this disclosure will be both thorough and complete, and will fully convey the scope of the invention and enable one of ordinary skill in the art to make, use and practice the invention.

Figure 1:
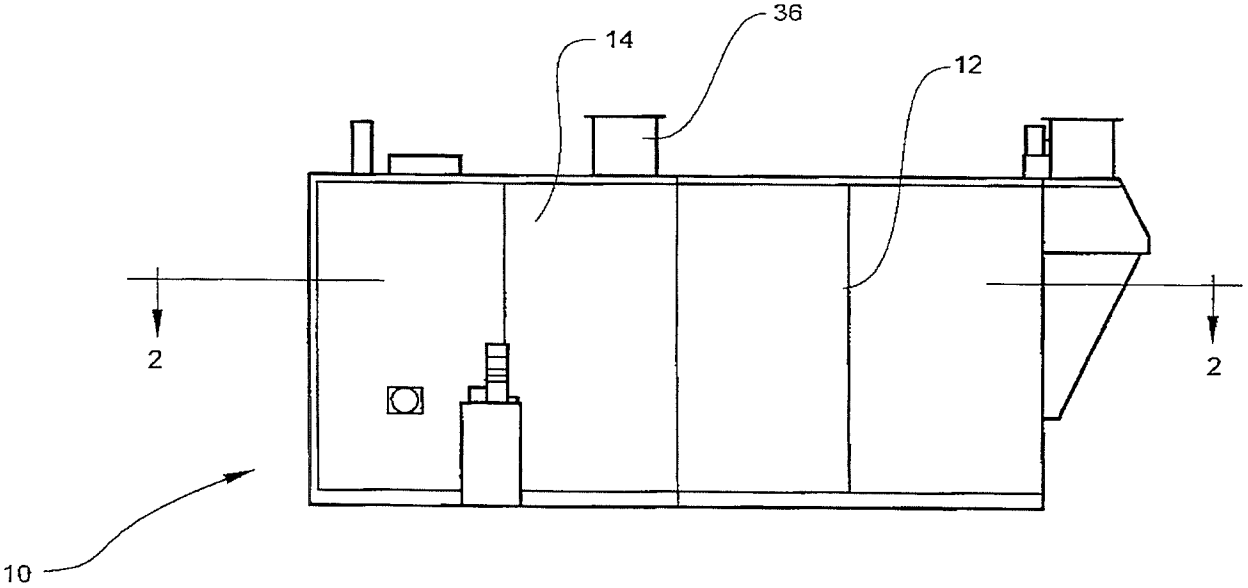
FIG. 1 is a side elevation view of a tunnel finisher according to an embodiment of the invention.
Figure 2:
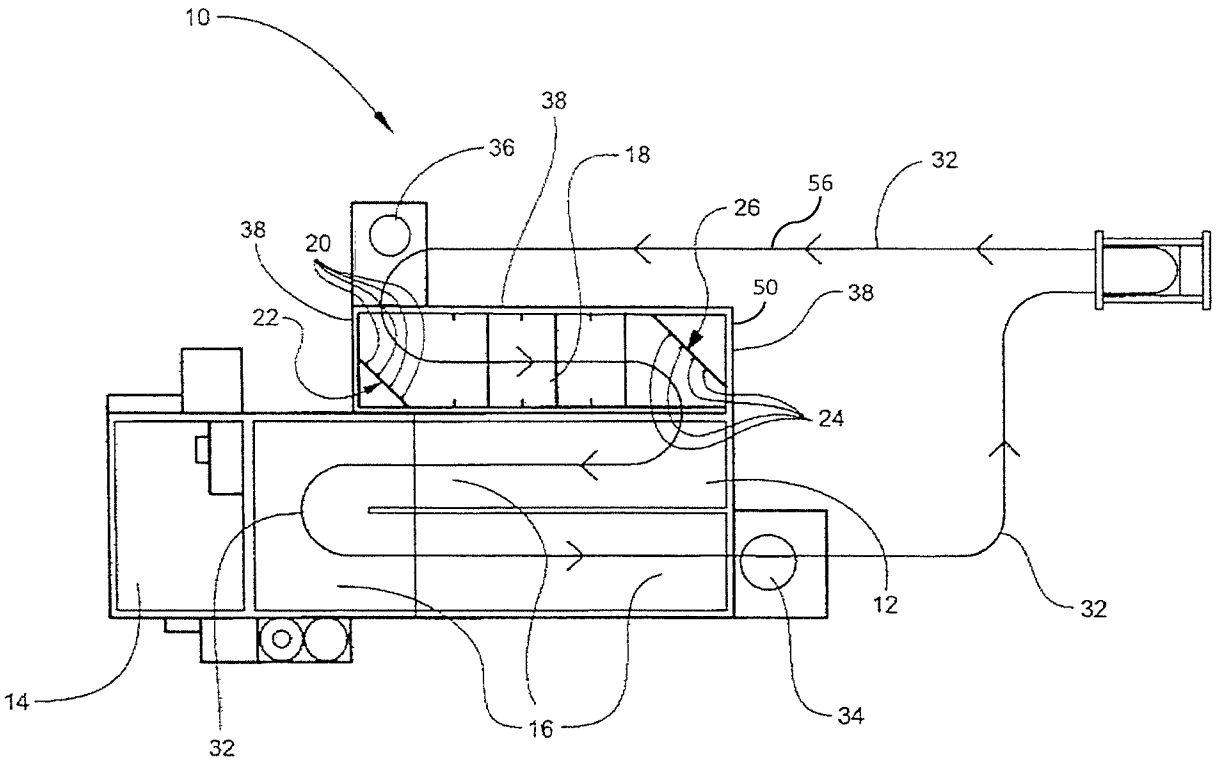
FIG. 2 is a horizontal cross-section of a tunnel finisher having a tunnel arrangement, conveyor path, hot water source, compressed air source, and hot air source.

Referring now specifically to the figures, a triple pass tunnel finisher according to a preferred embodiment of the present invention is illustrated in FIGS. 1 and 2 and is shown generally at reference numeral 10. The triple pass tunnel finisher 10 generally includes a front module 12, rear module 14 and a moisturizing module 18 providing a "moisturizing zone". The rear module 14 contains a blower for circulating hot air through the entire tunnel finisher 10, electric controls for controlling temperature, and a main operator control panel. Alternatively, the front module 12 can house the electric controls and main operator control panel. As shown in FIG. 2, the front module 12 contains a large portion of the hot air chambers 16, and the rear module 14 also contains a portion of the hot air chambers 16, including the U-turn portion as well as the heat source. The heat source can be a steam heat exchanger, electric heating coils, one or more gas burners, or other suitable heat source.

The moisturizing module 18 is a generally linear tunnel 50 defining a passage therethrough between an entrance 52 and an exit 54 of the tunnel, as shown positioned adjacent opposing ends of the tunnel 50 through sidewalls thereof. The moisturizing module 18 is further associated with a steam exhaust hood 36 and has a lower pressure than the hot air chambers 16, creating an air pressure differential. As shown in FIG. 1, the finisher 10 can also include an exit exhaust hood 34 for exiting hot gasses generated in the finishing process.

Figure 3:
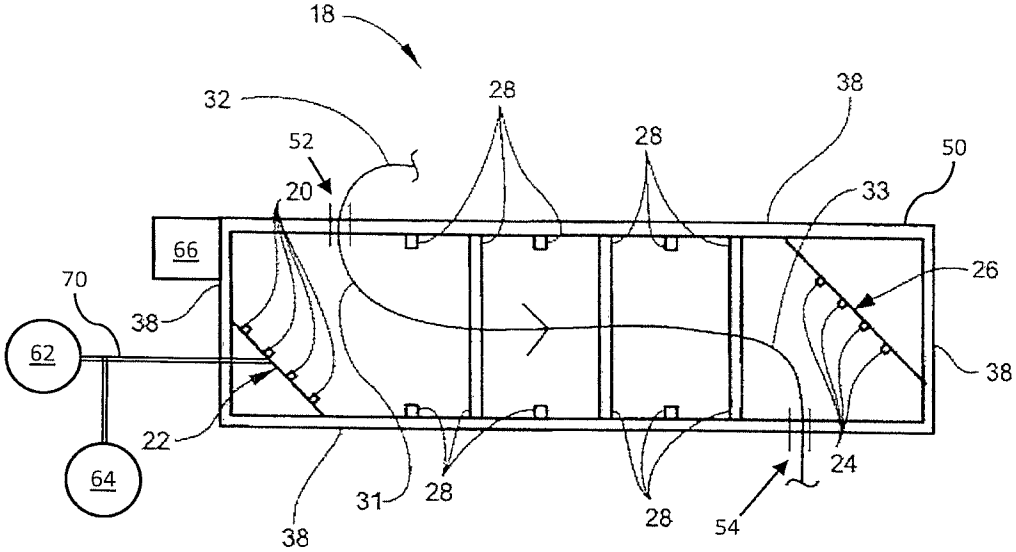
FIG. 3 is a horizontal cross-section of the tunnel providing the moisturizing zone.

Referring specifically to FIGS. 2 and 3, the laundry tunnel finisher 10 generally includes a garment conveyor 56 defining a non-linear conveyor pathway, or "flow path" 32 through tunnel 50 and the associated modules. As shown the conveyor defines a first curve 31 within tunnel 50 adjacent the entrance 52 and a second curve 33 within tunnel 50 adjacent the exit 54. In a specific embodiment, the conveyor pathway through tunnel 50 is generally linear at its mid-span and includes about 90-degree curved portions adjacent the entrance and exit.

Associated with the interior of tunnel 50 is at least one nozzle 20, and preferably a plurality of nozzles, directed toward the conveyor 56 to apply moisture to the garments as they pass through the moisturizing zone. As shown, a plurality of nozzles 20 are positioned about the outer curve of the first and second curves 31, 33 and thus are directed at non-perpendicular angles to the conveyor pathway. In an alternative embodiment, tunnel 50 additionally includes a plurality of nozzles 28 along its length that may or may not be oriented perpendicular to the conveyor pathway, such as from the sides and from above or below. In a preferred embodiment, the nozzles 20, 28 direct moisture to the garments as they travel around the curves 31, 33 and consequentially are separated and more open to receiving moisture.

Further associated with the moisturizing zone and tunnel 50 is a hot water source 62 for supplying hot water to the nozzles 20, a compressed air source 64 for supplying compressed air to the nozzles 20, and a hot air source 66 directing hot air into tunnel 50. Operationally, hot water from the hot water source 62 is atomized with compressed air from the compressed air source 64 and sprayed into tunnel 50 through the nozzles 20, 28 where it is then mixes with hot air from the hot air source 66 to raise the temperature in the moisturizing zone. Hot water and compressed air is preferably delivered to the nozzles 20 from their sources via a conventional pipe or line network 70 interconnected with each of the nozzles 20, or groups of nozzles, to provide independently controllable zones. Although only a single hot air source is shown at reference numeral 66, the finisher 10 preferably includes a plurality of hot air sources along its length in fluid communication with the interior of tunnel 50.

In a specific embodiment, hot water from the hot water source 62 has a preferred temperature range from about 150 degrees F. to about 190 degrees F., and hot air from the hot air source 66 has a preferred temperature range from about 220 degrees F. to about 300 degrees F. The hot air supplied to the moisturizing zone from the hot air source 66 raises the temperature in the moisturizing zone with less effort and cost than steam production, while providing a better effect.

The flow path 32 can be a chain conveyor or other suitable conveyance means, and the garments can be carried on hangers by the conveyor through the finisher 10. As the garments enter the moisturizing module 18 on the chain conveyer, they travel along the radius of the first curve 31 of the flow path 32, which spreads the garment open as it is immediately injected with heated, atomized spray from the nozzles 20 positioned on a first row 22, as shown in FIG. 2. The nozzles 20 may be positioned at a 45-degree angle in relation to the walls 38 of the moisturizing module 18. Such positioning allows the moisture to thoroughly penetrate the garment, which is particularly beneficial for the conditioning of laundered shirts, pants, and jackets.

After traveling along the first curve 31 of the flow path 32, the hangers on which the garments hang return to their normal operating form as the garment proceeds on a substantially straight portion of the flow path 32 in the moisturizing module 18. The garment then enters the second curve 33 on the flow path 32 leading to the exit of the moisturizing module 18. As the garments travel the radius of the second curve 33 they are again spread open, and exposed to another steam injection from steam nozzles 24 positioned on a second row 26. The garments then exit the moisturizing module 18 and make a U-turn entering the second tunnel or higher pressurized hot air chamber 16. Preferably, the second row 26 is positioned in the moisturizing module 18 diagonally oriented from the first row 22 as shown in FIGS. 2 and 3. In addition, nozzles 24 of the second row 22 are preferably positioned at a 45-degree angle in relation to the walls 38 of tunnel 50.

The front module 12 includes the hot air chambers 16, with the exception of the single U-turn portion of the hot air chambers 16 that are located in the rear module 14. The hot air chambers 16 include two separate chambers in which air from a hot air plenum is directed down through the moving garments to complete the drying process. The two chamber arrangement allows for even air flow in each chamber, resulting in an increase in the air velocity. In addition, the hot air chambers 16 are positively pressurized to help prevent entry of relatively cooler air of the moisturizing module 18 from entering the chamber 16. The pressurization also minimizes the amount of cool air that is drafted into the moisturizing module 18 from outside of the finisher 10. This prevents heat loss, allowing the finisher 10 to be more efficient, while increasing the temperature at which the garments exit the moisturizing module 18 from about 71.1-degrees C. (160-degrees F), as is typical in conventional finishers, to about 93.3-degrees C (200-degrees F). This increase in temperature also enables faster drying times and less garment wrinkling, resulting in reduced dwell time for a garment with a high quality appearance.

Figure 4:
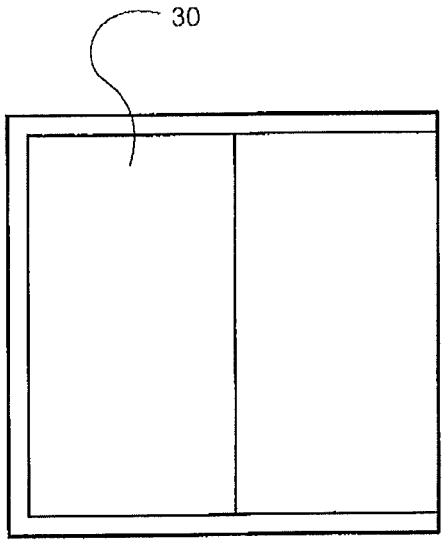
FIG. 4 is a side view of an expansion module.
Figure 5:
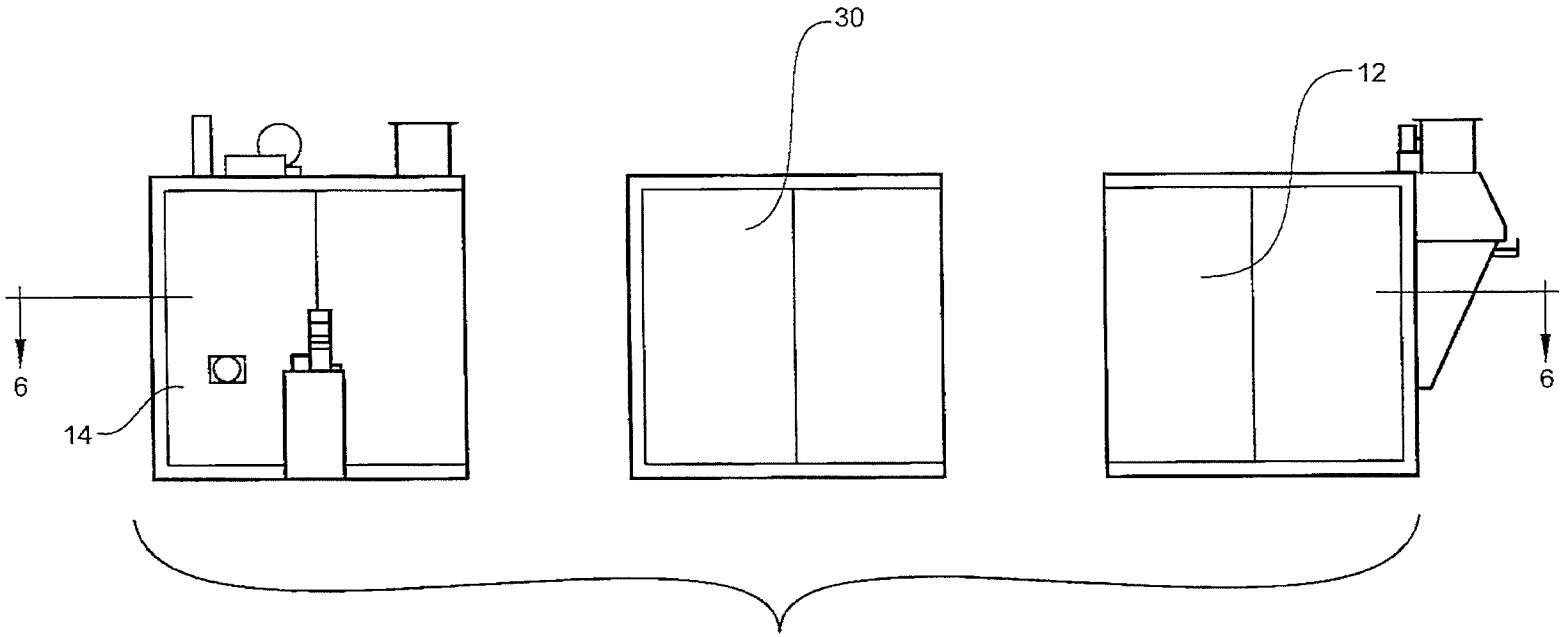
FIG. 5 is a side elevation of a tunnel finisher with a single expansion module according to the preferred embodiment.
Figure 6:
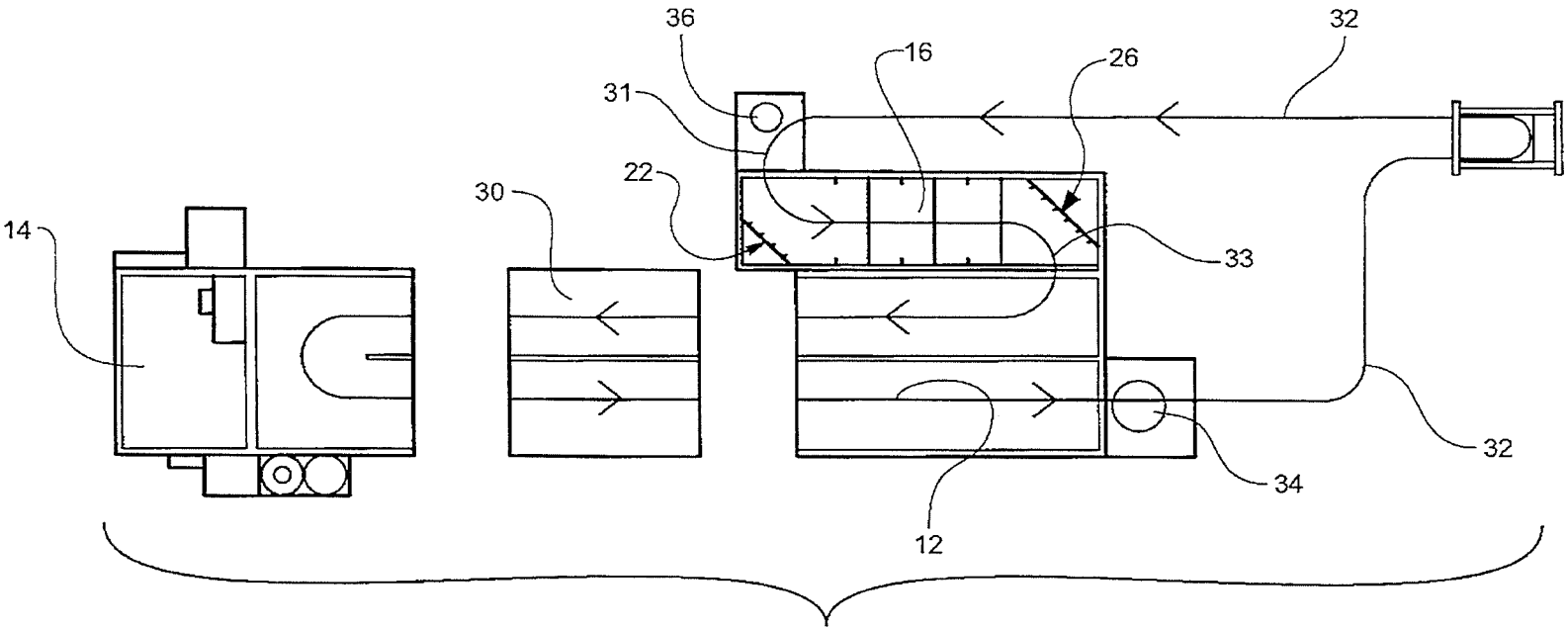
FIG. 6 is a horizontal cross-section of the tunnel finisher with a single expansion module according to the preferred embodiment.

An increase in production of the finisher 10 can be easily and inexpensively met by unbolting the modules 12, 14, 18 from each other, spreading them apart, and inserting, between the front module 12 and rear module 14, an expansion module 30, shown in FIGS. 4, 5, and 6. The expansion module 30 may contain only an airflow plenum needed to direct heated air onto the garments, and does not decrease the pressure differential between the moisturizing module 18 and hot air chambers 16. The conveyor chain and piping are lengthened to accommodate the new, longer length, and the system is complete. The simple construction of the expansion module 30, and the lack of need for other functional components, provides a very inexpensive way of increasing production. There is no need for additional electronics, heating capacity, or blowers. Furthermore, the expansion modules 30 may be manufactured in various lengths according to customer specifications.

While a laundry tunnel finisher has been described herein with reference to specific embodiments and examples, it is envisioned that various details of the invention may be changed without departing from the scope of the invention. Furthermore, the foregoing description of the preferred embodiments of the invention and best mode for practicing the invention are provided for the purpose of illustration only and not for the purpose of limitation.

The invention claimed is:

1. A fabric processing machine, comprising:

(a) a housing having a moisturizing zone therein for processing fabric with moisture, the machine characterized by the absence of an operable steam-generating boiler for projecting steam onto the fabric being processed in the machine;

(b) at least one liquid hot water nozzle positioned within the moisturizing zone;

(c) a hot liquid water source for supplying hot liquid water to the at least one liquid hot water nozzle;

(d) a compressed air source for supplying compressed air to the at least one liquid hot water nozzle; and (e) a hot air source for directing hot air into the moisturizing zone of the housing; wherein hot liquid water from the hot liquid water source is atomized with compressed air from the compressed air source and sprayed into the moisturizing zone through the at least one liquid hot water nozzle and is mixed with hot air from the hot air source to raise the temperature in the moisturizing zone.

2. The fabric processing machine according to claim 1, further comprising a plurality of liquid hot water nozzles arranged into rows and positioned in the moisturizing zone.

3. The fabric processing machine according to claim 1, wherein the moisturizing zone comprises an elongate tunnel.

4. The fabric processing machine according to claim 1, wherein the machine is a laundry tunnel finisher.

5. The fabric processing machine according to claim 1, further including an exhaust hood for exhausting moisture-laden air.

6. The fabric processing machine according to claim 1, wherein hot liquid water from the hot water source has a temperature from about 150 degrees F. to about 190 degrees F.

7. The fabric processing machine according to claim 1, wherein hot air from the hot air source has a temperature from about 220 degrees F. to about 300 degrees F.

8. A fabric processing machine, comprising:

(a) a housing having an entrance and an exit positioned adjacent opposed ends of the housing and defining a moisturizing zone, the fabric processing machine characterized by the absence of an operable steam-generating boiler for projecting steam onto fabric being processed in the housing;

(b) a fabric conveyor defining a conveyor pathway extending between the entrance and the exit of the housing;

(c) a plurality of liquid hot water nozzles disposed within the moisturizing zone and directed at the conveyor pathway;

(d) a hot liquid water source supplying hot water to the liquid hot water nozzles;

(e) a compressed air source supplying compressed air to the liquid hot water nozzles; and (f) a hot air source directing hot air into the moisturizing zone; wherein hot liquid water from the hot liquid water source is atomized with compressed air from the compressed air source and sprayed into the moisturizing zone through the liquid hot water nozzles and is mixed with hot air from the hot air source to raise the temperature in the moisturizing zone.

9. The fabric processing machine according to claim 8, wherein the liquid hot water nozzles are directed at non-perpendicular angles relative to the conveyor pathway.

10. The fabric processing machine according to claim 8, wherein hot liquid water from the of liquid water source has a temperature from about 150 degrees F. to about 190 degrees F.

11. The fabric processing machine according to claim 8, wherein hot air from the hot air source has a temperature from about 220 degrees F. to about 300 degrees F.

12. A fabric processing machine having a housing defining a moisturizing zone therein, the housing including a non-linear conveyor pathway through the moisturizing zone having curved portions adjacent an entrance and an exit of the housing, at least one liquid hot water nozzle directed at the curved portions of the pathway, a hot liquid water source supplying hot liquid water to the at least one liquid hot water nozzle, a compressed air source supplying compressed air to the at least one liquid hot water nozzle, and a hot air source directing hot air into the moisturizing zone, wherein the hot liquid water is atomized using the compressed air and is sprayed through the at least one liquid hot water nozzle and mixed with the hot air in the moisturizing zone to raise the temperature in the moisturizing zone, wherein the machine is characterized by the absence of an operable steam-generating boiler for projecting steam onto fabric being processed in the machine.

13. The fabric processing machine according to claim 12, wherein hot liquid water from the hot liquid water source has a temperature from about 150 degrees F. to about 190 degrees F.

14. The fabric processing machine according to claim 12, wherein hot air from the hot air source has a temperature from about 220 degrees F. to about 300 degrees F.

15. The fabric processing machine according to claim 12, wherein the machine is adapted to process fabric in garment form, and wherein the machine includes a conveyor for moving garments being processed into, through and out of the housing.

* * * * *